US012551066B2

(12) United States Patent
Ko et al.

(10) Patent No.: US 12,551,066 B2
(45) Date of Patent: Feb. 17, 2026

(54) SANITARY WASHING DEVICE

(71) Applicant: TOTO LTD., Kitakyushu (JP)

(72) Inventors: Yuki Ko, Kitakyushu (JP); Masayuki Mochita, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 202 days.

(21) Appl. No.: 18/355,459

(22) Filed: Jul. 20, 2023

(65) Prior Publication Data

US 2024/0057827 A1 Feb. 22, 2024

(30) Foreign Application Priority Data

Aug. 16, 2022 (JP) ..... 2022-129705

(51) Int. Cl.
*A47K 13/30* (2006.01)

(52) U.S. Cl.
CPC ..... *A47K 13/302* (2013.01)

(58) Field of Classification Search
CPC ..... A47K 13/30–302; E03D 9/00–007; E03D 5/10–105
See application file for complete search history.

(56) References Cited

U.S. PATENT DOCUMENTS

| | | | | |
|---|---|---|---|---|
| 8,082,607 | B2 * | 12/2011 | Matsushita | A47K 13/302 4/444 |
| 10,584,469 | B2 * | 3/2020 | Nogoshi | E03D 9/08 |
| 10,597,857 | B2 * | 3/2020 | Nogoshi | E03D 9/002 |
| 12,156,618 | B2 * | 12/2024 | Chen | A47K 13/302 |
| 2007/0256226 | A1 * | 11/2007 | Pinizzotto | E03D 9/08 4/420.4 |
| 2009/0217447 | A1 | 9/2009 | Matsushita et al. | |
| 2012/0144569 | A1 * | 6/2012 | Kodat | A47K 13/302 4/222 |
| 2018/0087254 | A1 | 3/2018 | Lloyd et al. | |

FOREIGN PATENT DOCUMENTS

| | | | | |
|---|---|---|---|---|
| CN | 103352507 | A | 10/2013 | |
| JP | S60-100482 | U | 7/1985 | |
| JP | H05-118068 | A | 5/1993 | |
| JP | 2002-348937 | A | 12/2002 | |
| JP | 2005-105630 | A | 4/2005 | |
| JP | 2007-319412 | A | 12/2007 | |
| JP | 2019-166201 | A | 10/2019 | |
| JP | 2022-017123 | A | 1/2022 | |
| WO | WO2007129714 | * | 11/2007 | A47K 13/247 |

OTHER PUBLICATIONS

Notice of Reasons for Refusal for Japanese Patent Application No. 2022-129705 dated Nov. 1, 2024.

* cited by examiner

*Primary Examiner* — Erin Deery
*Assistant Examiner* — Nicholas A Ros
(74) *Attorney, Agent, or Firm* — McDonald Hopkins LLC

(57) ABSTRACT

A sanitary washing device includes a casing, a toilet lid, a rotation detection sensor, a human body detection sensor, a spray device, and a control device. The casing is disposed at a toilet. The toilet lid is rotatably mounted on the casing. The rotation detection sensor detects a rotation of the toilet lid. The human body detection sensor detects a human body when the toilet lid is in an open state. The spray device sprays a mist into the toilet. The control device controls the spray device. The control device operates the spray device when the rotation detection sensor detects an opening operation of the toilet lid, or when the human body detection sensor detects a human body.

4 Claims, 7 Drawing Sheets

SANITARY WASHING DEVICE

CROSS-REFERENCE TO RELATED APPLICATIONS

This application is based upon and claims the benefit of priority from Japanese Patent Application No. 2022-129705, filed on Aug. 16, 2022; the entire contents of which are incorporated herein by reference.

FIELD

Embodiments described herein relate generally to a sanitary washing device.

BACKGROUND

A sanitary washing device which sprays water into the bowl of a toilet is known in the art (JP-US60-100482 (Jikkai)). The device suppresses the adhesion of feces and the like to the surface of the bowl by forming a water film on the surface of the bowl.

The toilet described in JP-US60-100482 (Jikkai) sprays water from a spray pump when the toilet lid is being opened. Accordingly, since the toilet described in JP-US60-100482 (Jikkai) cannot spray water while the toilet lid remains in the open state, the hygiene of the toilet may deteriorate.

SUMMARY

According to the embodiment, a sanitary washing device includes a casing, a toilet lid, a rotation detection sensor, a human body detection sensor, a spray device, and a control device. The casing is disposed at a toilet. The toilet lid is rotatably mounted to the casing. The rotation detection sensor detects a rotation of the toilet lid. The human body detection sensor detects a human body when the toilet lid is in an open state. The spray device sprays a mist into the toilet. The control device controls the spray device. The control device operates the spray device when the rotation detection sensor detects an opening operation of the toilet lid, or when the human body detection sensor detects a human body.

DETAILED DESCRIPTION

A first invention is a sanitary washing device including a casing disposed at a toilet, a toilet lid rotatably mounted to the casing, a rotation detection sensor that is disposed at the casing and is configured to detect a rotation of the toilet lid, a human body detection sensor that is disposed at the casing and is configured to detect a human body when the toilet lid is in an open state, a spray device that is disposed at the casing and is configured to spray a mist into the toilet, and a control device configured to control the spray device; wherein the control device is configured to operate the spray device when the rotation detection sensor detects an opening operation of the toilet lid, or when the human body detection sensor detects a human body.

According to the sanitary washing device, hygiene can be improved because the spray device can be operated regardless of whether the toilet lid is open or closed. Also, the human body detection sensor is configured to detect a human body when the toilet lid is in the open state. Accordingly, for example, the cost of the sensor can be less than that of a human body detection sensor that irradiates light capable of passing through the toilet lid.

A second invention is the sanitary washing device of the first invention, wherein the control device is configured to set the spray device to be inoperative for a prescribed interval after an operation of the spray device ends.

According to the sanitary washing device, it is possible to conserve water and electricity while keeping the device clean.

A third invention is the sanitary washing device of the first or second invention, wherein the rotation detection sensor is configured to detect the opening operation of the toilet lid at a position within a range of not more than half of a rotation range of the toilet lid.

According to the sanitary washing device, the spray device can be operated as quickly as possible. Accordingly, more mist can be adhered to the toilet before the user is seated on the toilet seat.

Also, the device can prevent the mist from contacting the user seated on the toilet seat because the mist spraying can be finished before the user is seated on the toilet seat.

A fourth invention is the sanitary washing device of the first or second invention, wherein the toilet lid covers an entirety of the casing when viewed in front-view when the toilet lid is in a closed state.

According to the sanitary washing device, since the casing is not visible, the device gives the user an impression that it looks neat, and thus the designability is improved.

An embodiment of the invention will now be described with reference to FIGS. 1 to 7.

Figure 1:
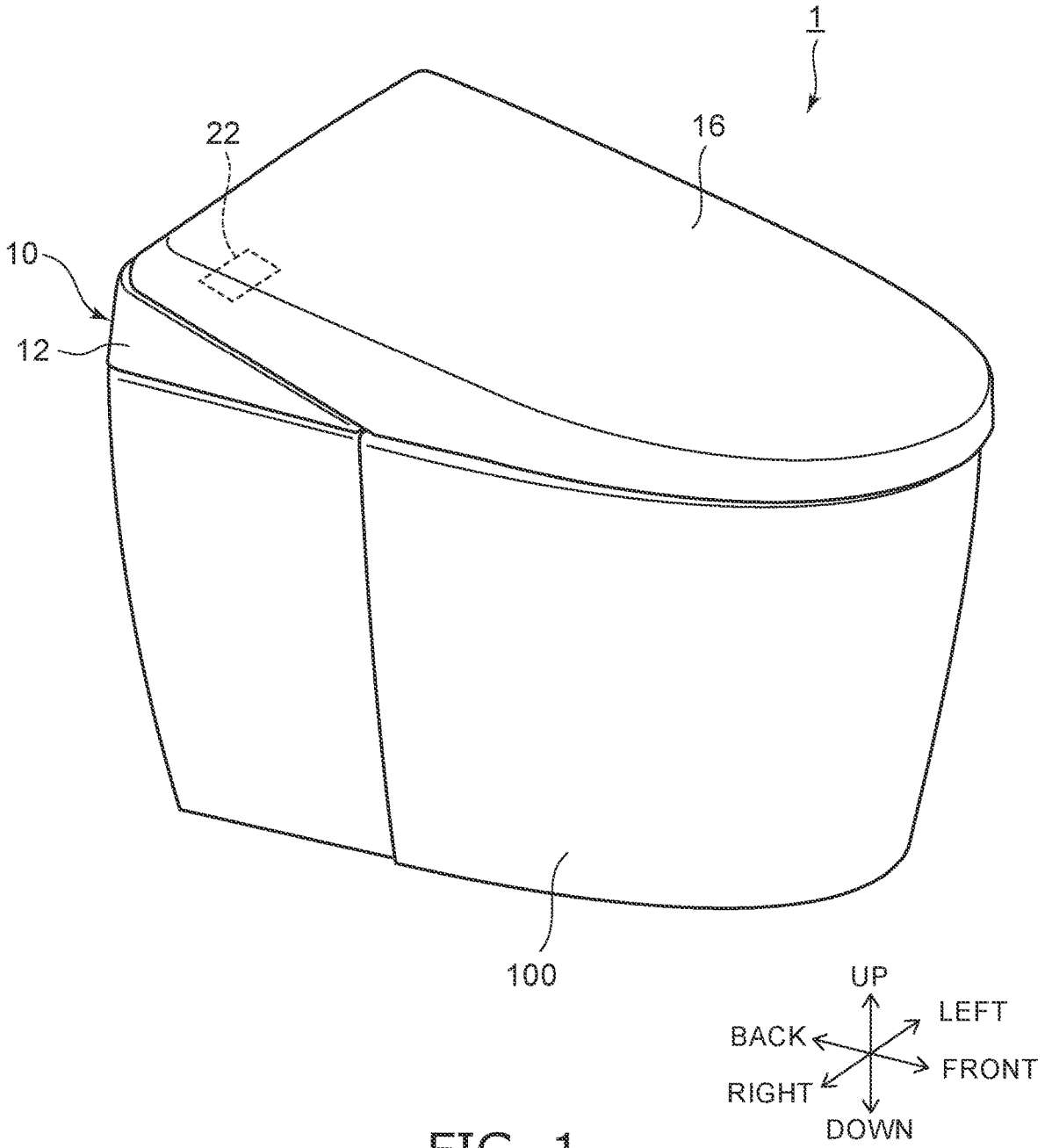
FIG. 1 is a perspective view showing a toilet device according to the embodiment of the invention.

FIG. 1 is a perspective view showing a toilet device according to the embodiment of the invention.

Figure 2A:
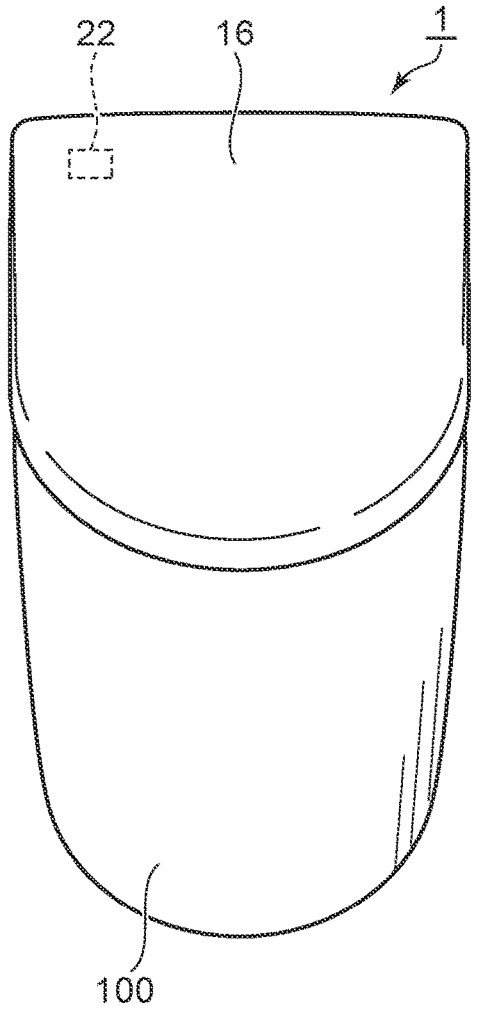
FIGS. 2A and 2B are front views of the toilet device of FIG. 1 when viewed from the front.
Figure 2B:
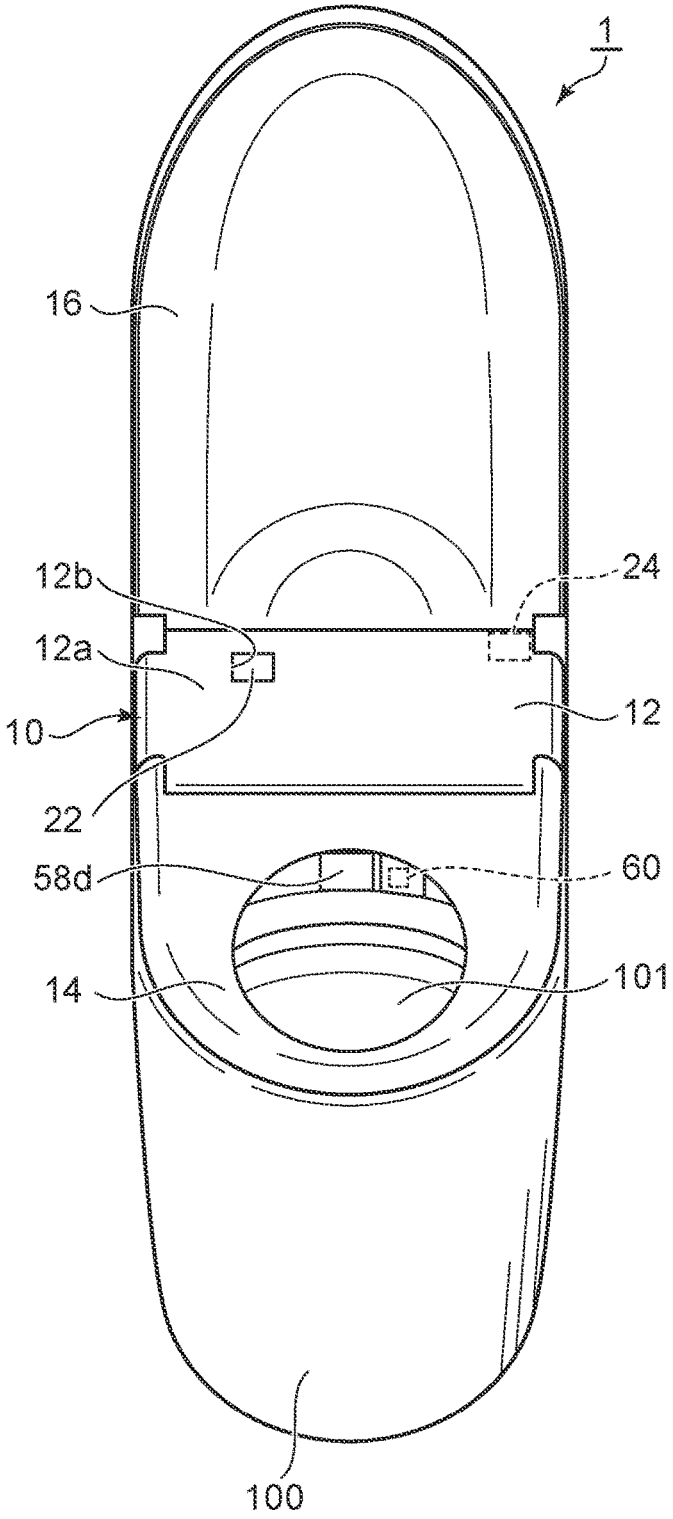

FIGS. 2A and 2B are front views of the toilet device of FIG. 1 when viewed from the front. FIG. 2A shows the toilet lid in the closed state. FIG. 2B shows the toilet lid in the open state.

The toilet device 1 shown in FIG. 1 includes a western-style sit-down toilet (called simply the "toilet 100" for convenience in the following description) and a sanitary washing device 10. As shown in FIG. 2B, the toilet 100 includes a concave bowl 101 that receives human waste. The sanitary washing device 10 is mounted to the upper part of the toilet 100.

The sanitary washing device 10 includes a casing 12. The casing 12 is arranged behind the toilet 100. A toilet seat 14 on which the user is seated is rotatably supported by the casing 12. A toilet lid 16 is rotatably supported by the casing 12 to cover the toilet seat 14. FIG. 1 shows the state in which the toilet seat 14 and the toilet lid 16 are closed (the lowered state).

As shown in FIG. 2A, the toilet lid 16 covers an entirety of the casing 12 when viewed in front-view when the toilet lid 16 is in the closed state. In other words, the toilet lid 16 is formed in a full-cover shape covering an upper surface 12*a* of the casing 12 in the closed state. Accordingly, the toilet device 1 has good designability which imparts to the user an impression of neatness.

Embedded inside the casing 12 are a body wash function part 58 that washes a human body private part (the "bottom" or the like) of the user sitting on the toilet seat 14, and a spray device 60 that sprays a mist M into the bowl 101, etc. A nozzle 58*a* of the body wash function part 58 can be advanced into the bowl 101 of the toilet 100, when a seating detection sensor 20 detects the user sitting on the toilet seat 14, and when the user operates a manual operation unit 26 with, for example, a remote control, etc.

One or multiple water discharge ports are provided in the tip portion of the nozzle 58*a*. The nozzle 58*a* can wash the "bottom" or the like of the user by discharging water from the water discharge port provided in the tip portion toward the private part of the user seated on the toilet seat 14. In this specification, "up", "down", "front", "back" or "behind", "left", and "right" each are directions when viewed by the user sitting on the toilet seat 14 with the user's back facing the open toilet lid 16.

Toilet flushing (the operation of discharging the human waste inside the bowl 101 and washing the interior of the bowl 101) is performed when the user performs the toilet flush operation with a switch provided in the manual operation unit 26 (the remote control), or when the user stands up from the toilet seat 14. In the toilet flushing, wash water is supplied to the bowl 101, and then the remaining water stays in the bowl 101.

Figure 3:
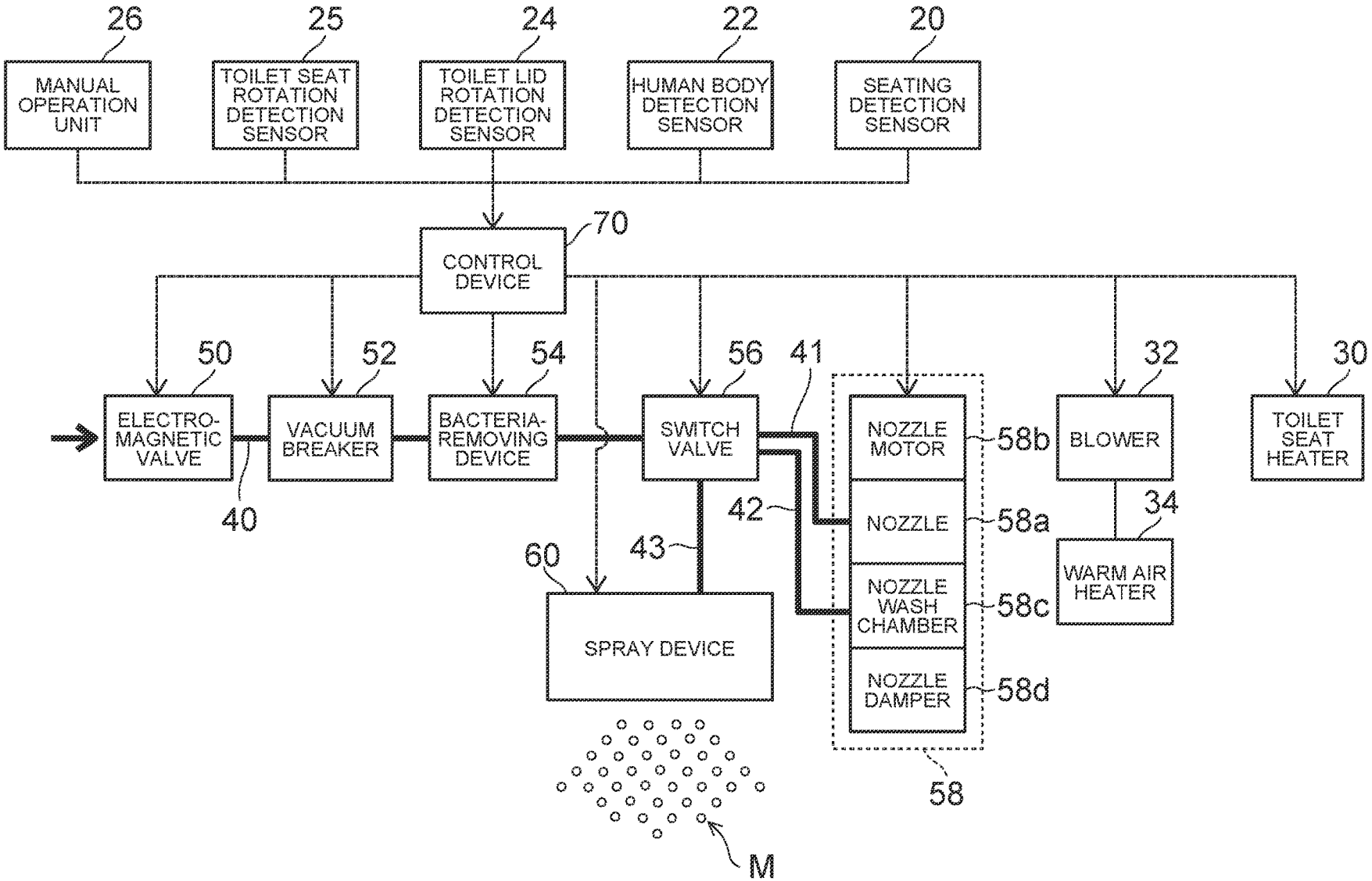
FIG. 3 is a block diagram showing relevant components of the sanitary washing device.

FIG. 3 is a block diagram showing relevant components of the sanitary washing device. FIG. 3 illustrates the relevant components of both the water channel system and the electrical system.

Figure 4:
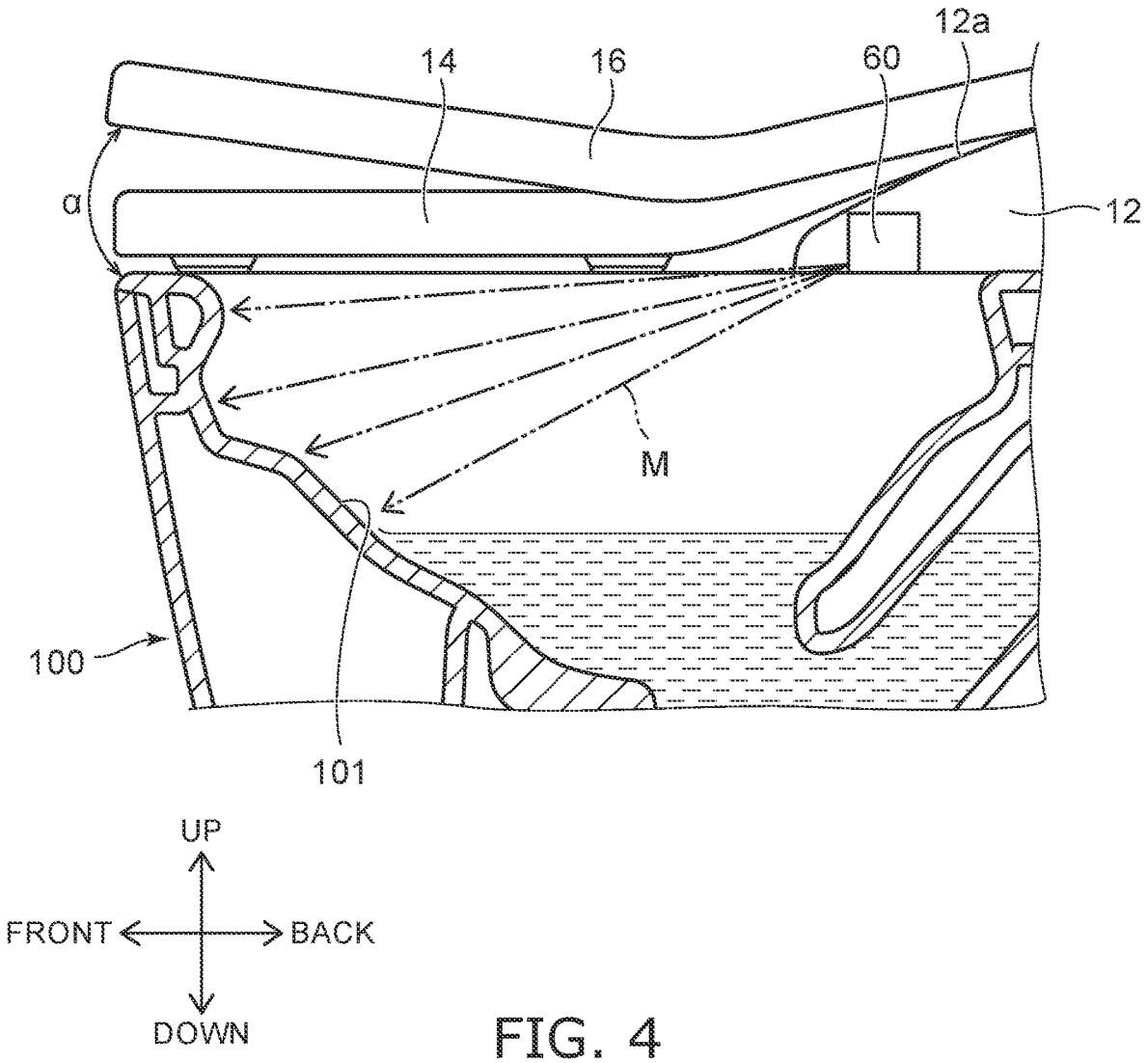
FIG. 4 is a cross-sectional view showing a state in which the toilet lid is opened and mist is sprayed from the spray device.

FIG. 4 is a cross-sectional view showing a state in which the toilet lid is opened and mist is sprayed from the spray device.

The seating detection sensor 20 can detect whether or not the user is seated on the toilet seat 14. The seating detection sensor 20 detects that the user is seated or has left the seat. The seating detection sensor 20 is, for example, a contact sensor such as a tactile switch, an electrostatic sensor, a strain sensor, or the like, which is disposed at the toilet seat 14.

When the user sits on the toilet seat 14, a tactile switch is pressed down by the body weight of the user, or the user contacts an electrostatic sensor, or pressure is applied to a strain sensor by the body weight of the user. The seating of the user can be detected using electrical signals from one or more of these sensors. The seating detection sensor 20 transmits the detection result to a control device 70. The seating detection sensor 20 may be a pyroelectric sensor, a distance sensor (an infrared sensor), or the like, which is disposed at the casing 12.

A human body detection sensor 22 is disposed at the casing 12 and is configured to detect a human body when the toilet lid 16 is in the open state. The human body detection sensor 22 is, for example, a pyroelectric sensor, a distance sensor (infrared sensor), or the like. When the toilet lid 16 is in the open state, the human body detection sensor 22 can detect the user in front of the toilet 100 through an opening 12*b* formed in the upper surface 12*a* of the casing 12.

In other words, when the toilet lid 16 is in the closed state, the human body detection sensor 22 cannot detect the human body because the opening 12*b* is covered with the toilet lid 16. The light such as infrared light or the like irradiated by the human body detection sensor 22 is not transmitted when the human body detection sensor 22 is shielded by a resin material other than a transparent resin, a special resin, etc. For example, the irradiated light of the human body detection sensor 22 is not transmitted when the human body detection sensor 22 is shielded by the toilet lid 16. It is favorable for the human body detection sensor 22 to detect the human body by using infrared light. The human body detection sensor 22 may detect the human body by using irradiated light of a shorter wavelength than infrared light. The human body detection sensor 22 is, for example, a pyroelectric sensor, a distance sensor, a laser sensor, etc.

Accordingly, for example, the human body detection sensor 22 does not include a microwave sensor (a doppler sensor) or the like of which the irradiated light is transmitted through the toilet lid 16 to detect a human body even when the toilet lid 16 is in the closed state. In other words, the toilet device 1 does not include toilet devices in which the toilet lid 16 automatically opens and closes upon detecting the user in front of the toilet device 1.

The toilet lid 16 of the toilet device 1 is manually opened and closed by the user. The toilet lid 16 may be opened and closed based on the operation of an open/close switch of the manual operation unit 26 (the remote control). Compared to a microwave sensor or the like, the cost of the human body detection sensor 22 can be reduced by using a pyroelectric sensor or a distance sensor.

When the toilet lid 16 is in the open state, the human body detection sensor 22 detects the user entering and exiting the toilet room in which the toilet device 1 is mounted. The human body detection sensor 22 may be inoperative (powered off) when the toilet lid 16 is in the closed state. The human body detection sensor 22 transmits the detection results (the presence or absence of the human body) to the control device 70. The control device 70 operates the spray device 60 described below when the human body detection sensor 22 detects a human body. Specific operating conditions of the spray device 60 are described below.

A toilet lid rotation detection sensor 24 is disposed at the casing 12 and detects the rotation of the toilet lid 16. The toilet lid rotation detection sensor 24 is included in the rotation detection sensor of the invention. For example, the toilet lid rotation detection sensor 24 detects the rotation of a pivotally-supporting part (not illustrated) of the toilet lid 16. The toilet lid rotation detection sensor 24 is, for example, a two-phase pulse-type rotation detection sensor. The toilet lid rotation detection sensor 24 is, for example, a magnetic rotary encoder including a Hall IC. The toilet lid rotation detection sensor 24 may be a sensor that detects at least the change of the toilet lid 16 from the closed state to the open state. The toilet lid rotation detection sensor 24 detects the state when the user uses the toilet device 1.

The toilet lid rotation detection sensor 24 detects the opening operation of the toilet lid 16 at a position within a range of not more than half of the rotation range of the toilet lid 16. In other words, as shown in FIG. 4, the toilet lid rotation detection sensor 24 detects the opening operation of the toilet lid 16 when the toilet lid 16 opens from the fully-closed state to an angle $\alpha$. If the angle of the toilet lid 16 is 0 degrees in the fully-closed state and 100 degrees in the fully-open state, then the angle $\alpha$ has a value of not more than 50 degrees (half open). The angle $\alpha$ is favorably not more than 45 degrees, and more favorably not more than 30 degrees. By setting the angle $\alpha$ to be as small as possible, the use of the toilet device 1 can be detected more promptly.

When the opening operation of the toilet lid 16 is performed, the toilet lid rotation detection sensor 24 transmits the detection result to the control device 70. In other words, when the toilet lid 16 is in the open state, the state before the use of the toilet device 1 is detected by the human body detection sensor 22 detecting the human body. On the other hand, when the toilet lid 16 is in the closed state, the state before the use of the toilet device 1 is detected by the toilet lid rotation detection sensor 24 detecting the opening operation of the toilet lid 16.

A toilet seat rotation detection sensor 25 is disposed at the casing 12 and detects the rotation of the toilet seat 14. The toilet seat rotation detection sensor 25 has a configuration similar to that of the toilet lid rotation detection sensor 24; and a description is therefore omitted. When the opening operation of the toilet seat 14 is performed, the toilet seat rotation detection sensor 25 transmits the detection result to the control device 70. For example, when the mist M is being sprayed from the spray device 60 and the toilet seat rotation detection sensor 25 detects the opening operation of the toilet seat 14, the operation of the spray device 60 is stopped.

For example, the manual operation unit 26 is an operation unit for the user to spray bacteria-removing water at any timing. The manual operation unit 26 is a remote control that includes switches, buttons, etc., and transmits, to the control device 70, operation information (a signal) instructing the spraying of bacteria-removing water when the user operates the manual operation unit 26.

The control device 70 controls a bacteria-removing device 54 and/or the spray device 60 based on the operation information. The user can thereby spray bacteria-removing water by operating the manual operation unit 26. The manual operation unit 26 may include switches, buttons, etc., not only for spraying bacteria-removing water but also for the user to operate the functions of the sanitary washing device 10. When operations corresponding to the functions are performed, the operation information is transmitted to the control device 70. The control device 70 controls the operations of the components of the sanitary washing device 10 based on the operation information.

A toilet seat heater 30, a blower 32, a warm air heater 34, etc., are disposed inside the casing 12. For example, the toilet seat heater 30 is disposed inside the toilet seat 14. The toilet seat heater 30 includes, for example, a ring-shaped metal member disposed around an opening formed at the center of the toilet seat 14. The toilet seat heater 30 warms the toilet seat 14 when a current is provided based on a command from the control device 70.

The blower 32 is, for example, a fan disposed inside the casing 12. The blower 32 is operated based on a command from the control device 70. For example, the blower 32 can blow air into the toilet 100 (into the bowl 101) by vanes rotating as a motor rotates. For example, the blower 32 blows air to dry a private part of the user sitting on the toilet seat 14. The warm air heater 34 warms the air blown out of the casing 12 by the blower 32. Warm air is thereby blown toward the private part of the user; and the private part can be dried.

For example, the blower 32 may be operated when the spray device 60 is operated. The mist M squirted from the spray device 60 may be carried toward the toilet 100 and the toilet seat 14 by the air from the blower 32. The blower 32 and the warm air heater 34 may be provided as necessary.

In the water channel system, the sanitary washing device 10 includes pipe lines 40 to 43, an electromagnetic valve 50, a vacuum breaker 52, the bacteria-removing device 54, a switch valve 56, the nozzle 58*a*, a nozzle wash chamber 58*c*, and the spray device 60. These components are arranged inside the casing 12.

The pipe line 40 guides water supplied from a not-illustrated water supply source such as a service water line, a water storage tank, etc., to the spray device 60, the nozzle 58*a*, etc. The electromagnetic valve 50 is disposed at the upstream side of the pipe line 40. The electromagnetic valve 50 is an openable and closable electromagnetic valve and controls the supply of the water based on a command from the control device 70 disposed inside the casing 12.

The vacuum breaker 52 is disposed in the pipe line 40 downstream of the electromagnetic valve 50. The vacuum breaker 52 includes, for example, a flow channel that allows water to flow, an intake for drawing air into the flow channel, and a valve mechanism that opens and closes the intake. For example, the valve mechanism blocks the intake when water is flowing in the flow channel, and draws air into the flow channel by opening the intake when the flow of the water is stopped. In other words, the vacuum breaker 52 draws air when water does not flow in the pipe line 40. The valve mechanism includes, for example, a float valve.

For example, by drawing air into the pipe line 40 as described above, the vacuum breaker 52 promotes the water drainage of the part of the pipe line 40 downstream of the vacuum breaker 52. For example, the vacuum breaker 52 promotes the water drainage from the nozzle 58*a* and the spray device 60.

The bacteria-removing device 54 that generates bacteria-removing water is disposed in the pipe line 40 downstream of the vacuum breaker 52. For example, the bacteria-removing device 54 generates bacteria-removing water including hypochlorous acid, etc. An electrolytic cell unit is an example of the bacteria-removing device 54. The electrolytic cell unit electrolyzes water flowing through a space (a flow channel) between an anode plate (not illustrated) and a cathode plate (not illustrated) according to a control of the current provided from the control device 70.

The bacteria-removing water is not limited to bacteria-removing water that includes hypochlorous acid. The bacteria-removing water may be, for example, a solution including metal ions such as silver ions, copper ions, or the like, a solution that includes electrolytic chlorine, ozone, or the like, acidic water, alkaline water, etc. The bacteria-removing device 54 is not limited to an electrolytic cell and may have any configuration capable of generating bacteria-removing water.

The switch valve 56 is disposed in the pipe line 40 downstream of the bacteria-removing device 54. The spray device 60 and the nozzle 58*a* and the nozzle wash chamber 58*c* of the body wash function part 58 are disposed downstream of the switch valve 56. The switch valve 56 branches the pipe line 40 into the pipe line 41 that guides water to the nozzle 58*a*, the pipe line 42 that guides water to the nozzle wash chamber 58*c*, and the pipe line 43 that guides water to the spray device 60.

The switch valve 56 controls the opening and closing of the pipe lines 41, 42, and 43 based on commands from the control device 70. That is, the switch valve 56 controls the supply of the water to the nozzle 58*a*, the nozzle wash chamber 58*c*, and the spray device 60. Also, the switch valve 56 modifies the flow rate of the water supplied downstream of the switch valve 56. The pipe line 43 is a water supply part of the spray device 60.

The body wash function part 58 includes the nozzle 58*a*, a nozzle motor 58*b*, the nozzle wash chamber 58*c*, and a nozzle damper 58*d*. When not in use, the nozzle 58*a* is positioned behind the nozzle damper 58*d* and inside the casing 12. When washing the human body private part, etc., the nozzle 58*a* receives a drive force from the nozzle motor 58*b*, presses the nozzle damper 58*d* that is openable and closable with respect to the casing 12, and is advanced into the bowl 101 of the toilet 100. The nozzle motor 58*b* is driven based on a command from the control device 70. The nozzle 58*a* washes the human body private part by discharging water from the water discharge port in a state in which the nozzle 58*a* is advanced frontward from the casing 12. Water or bacteria-removing water is squirted from a squirt port provided inside the nozzle wash chamber 58*c* to wash the outer perimeter surface (the body) of the nozzle 58*a*.

The spray device 60 is disposed inside the casing 12 and sprays the mist M into the toilet 100. For example, the spray device 60 is disposed adjacent to the nozzle 58*a* of the body wash function part 58. For example, the mist M is made of water or bacteria-removing water having a smaller particle size than the water discharged from the nozzle 58*a* of the body wash function part 58, and is sprayed by the spray device 60 toward the inner surface of the toilet 100.

The spray device 60 wets the bowl 101 and the toilet seat 14 with the mist M of water or bacteria-removing water. "Wetting" in this specification refers to water or bacteria-removing water adhering to the surface of an object. The spray device 60 may be disposed in the nozzle 58*a*. For example, the mist M of water or bacteria-removing water may be sprayed from the tip of the nozzle 58*a*.

The control device 70 is disposed inside the casing 12 and includes a circuit which supplies power from a power supply circuit (not illustrated). The control device 70 includes, for example, an integrated circuit such as a microcomputer, etc. The control device 70 controls the spray device 60 based on the detection information of the human body detection sensor 22 and the detection information of the toilet lid rotation detection sensor 24. The control device 70 controls the toilet seat heater 30, the blower 32, the warm air heater 34, the electromagnetic valve 50, the vacuum breaker 52, the bacteria-removing device 54, the switch valve 56, the nozzle motor 58*b*, and the spray device 60 based on the command signals transmitted from the manual operation unit 26.

The control device 70 receives the detection information of the human body detection sensor 22 (a signal indicating the presence or absence of the user) and the detection information of the seating detection sensor 20 (a signal indicating whether or not the user is seated) and controls the operations of the components of the sanitary washing device 10 based on the received detection information.

The control device 70 performs a toilet wash process of spraying the mist M from the spray device 60 into the toilet 100. The toilet wash process includes, for example, multiple modes of a pre-mist mode, an after-mist mode, a periodic mist mode, and a manual mist mode.

The pre-mist mode is a mode in which the mist M of water or bacteria-removing water is automatically sprayed before the use of the toilet device 1 by the user. The after-mist mode is a mode in which the mist M of bacteria-removing water is automatically sprayed after the use of the toilet device 1 by the user. The periodic mist mode is, for example, a mode in which the mist M of bacteria-removing water is automatically sprayed at a set time, at a time interval, etc. The manual mist mode is a mode in which the mist M of water of bacteria-removing water is sprayed based on the operation information of the manual operation unit 26. The after-mist mode, the periodic mist mode, and the manual mist mode may be set as necessary. In other words, according to the embodiment, it is sufficient to include at least the pre-mist mode.

The sanitary washing device 10 according to the embodiment has the configuration described above. The pre-mist mode performed by the spray device 60 will now be described.

Figure 5:
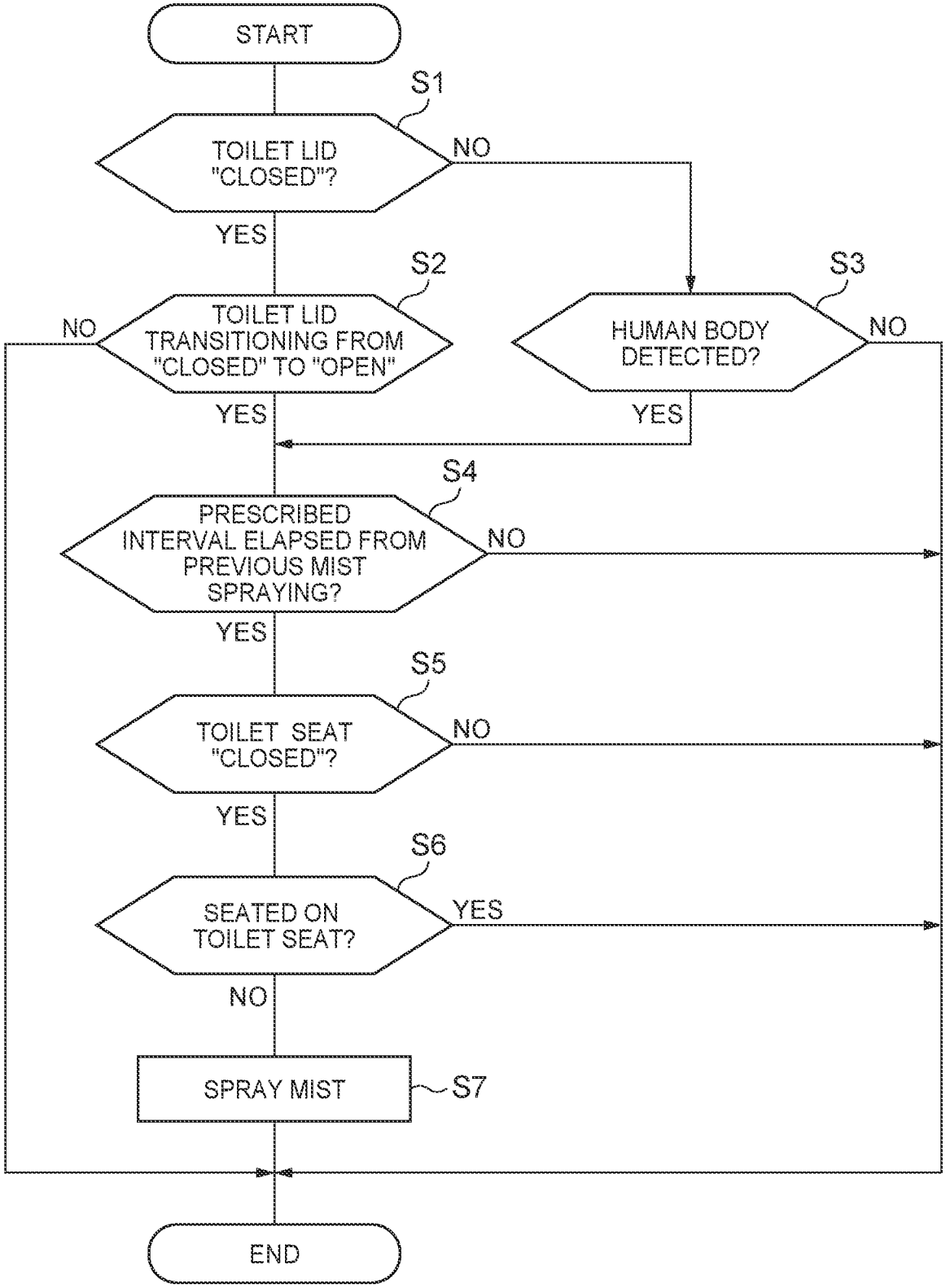
FIG. 5 is a flowchart of the pre-mist control performed by the control device.

FIG. 5 is a flowchart of the pre-mist control performed by the control device. For example, the control processing shown in FIG. 5 is prestored (retained) in a storage part (not illustrated) of the control device 70. For example, the control processing shown in FIG. 5 is repeatedly performed at a prescribed period from when the sanitary washing device 10 is provided with power. Each step in FIG. 5 is indicated by "S".

First, in S1, it is determined whether or not the toilet lid 16 is in the closed state. The control device 70 can use the detection result of the toilet lid rotation detection sensor 24 to recognize whether the toilet lid 16 is in the open state or the closed state. When S1 is "YES", that is, when the toilet lid 16 is determined to be in the closed state, the flow proceeds to S2. On the other hand, when S1 is "NO", that is, when the toilet lid 16 is determined to be in the open state, the flow proceeds to S3.

In S2, it is determined whether or not the opening operation of the toilet lid 16 has been performed from the closed state. In other words, it is determined whether or not the toilet lid rotation detection sensor 24 has detected that the toilet lid 16 is "open" from the "closed" state when the user opens the toilet lid 16. Specifically, the toilet lid rotation detection sensor 24 detects the opening operation of the toilet lid 16 when the toilet lid 16 is opened to the angle $\alpha$ from the closed state.

Then, when S2 is "YES", that is, when it is determined that the opening operation of the toilet lid 16 from the closed state has been performed, the flow proceeds to S4. On the other hand, the flow ends when S2 is "NO", that is, when it is determined that the opening operation of the toilet lid 16 from the closed state has not been performed. Thus, when the toilet lid 16 is closed, the control device 70 recognizes the user of the toilet device 1 by detecting the opening operation of the toilet lid 16 with the toilet lid rotation detection sensor 24.

In S3, it is determined whether or not a human body is detected. In other words, when the toilet lid 16 is in the open state, the human body detection sensor 22 detects the user of the toilet device 1. Then, when S3 is "YES", that is, when it is determined that a human body is detected, the flow proceeds to S4. On the other hand, the flow ends when S3 is "NO", that is, when it is determined that a human body is not detected. Thus, when the toilet lid 16 is open, the control device 70 recognizes the user of the toilet device 1 by detecting the user with the human body detection sensor 22.

In S4, it is determined whether or not a prescribed interval has elapsed from the previous mist spraying. The previous mist spraying is performed using one of the pre-mist mode, the after-mist mode, the periodic mist mode, or the manual mist mode. When the mist M is sprayed from the spray device 60, the control device 70 operates a timer from the end of the mist spraying. Then, the control device 70 determines whether or not the user uses the toilet device 1 within the timer measurement. The prescribed interval is set to the time until the water or bacteria-removing water dries after being adhered to the surface of the bowl 101, and is prestored in the storage part of the control device 70. The prescribed interval is several tens of seconds (e.g., 90 seconds).

Then, when S4 is "YES", that is, when it is determined that a prescribed interval has elapsed from the previous mist spraying, the flow proceeds to S5. The flow ends when S4 is "NO", that is, when it is determined that a prescribed interval has not elapsed from the previous mist spraying.

Thus, in the example, the pre-mist mode is not performed when the bowl 101 is assumed to be wetted with water or bacteria-removing water. Unnecessary mist spraying can be reduced thereby, and it is possible to conserve water and electricity.

In S5, it is determined whether the toilet seat 14 is in the closed state or the open state. The control device 70 can recognize the open or closed state of the toilet seat 14 based on the detection result of the toilet seat rotation detection sensor 25. Then, when S5 is "YES", that is, when the toilet seat 14 is determined to be in the closed state, the flow proceeds to S6. On the other hand, the flow ends when S5 is "NO", that is, when the toilet seat 14 is determined to be in the open state.

Here, if the mist M is sprayed from the spray device 60 when the toilet seat 14 is in the open state, there is a risk that the mist M may leak outward from the opening of the bowl 101. Therefore, in the example, the pre-mist mode is not performed when the toilet seat 14 is in the open state. Also, when the mist M is being sprayed from the spray device 60, the mist spraying is stopped when the toilet seat 14 transitions to the open state. S5 may be set as necessary. In other words, the pre-mist mode may be performed regardless of the open or closed state of the toilet seat 14.

In S6, it is determined whether or not the user is seated on the toilet seat 14. The control device 70 determines whether or not the user is seated on the toilet seat 14 based on the detection result of the seating detection sensor 20. Then, the flow ends when S6 is "YES", that is, when the user is determined to be seated on the toilet seat 14. On the other hand, when S6 is "NO", that is, when the user is determined not to be seated on the toilet seat 14, the flow proceeds to S7.

Here, if the mist M is sprayed in the state in which the user is seated on the toilet seat 14, there is a risk that the mist M may contact the buttocks of the user. Therefore, in the example, the pre-mist mode is not performed when the user is seated on the toilet seat 14. When the user sits on the toilet seat 14 when the mist M is being sprayed from the spray device 60, the mist spraying is stopped.

In S7, the mist spraying is performed. In other words, the control device 70 performs the pre-mist mode, and the flow ends. The control device 70 transmits a command signal based on the pre-mist mode to the spray device 60. When receiving the command signal, the spray device 60 sprays water into the bowl 101. For example, the spray time of the mist M is set by considering the spray amount and/or spray velocity of the mist M, the shape and size of the toilet 100, the time until the user is seated on the toilet seat 14, etc.

For example, the spray device 60 sprays the mist M for several seconds (e.g., 4 seconds). When the toilet lid 16 is open, the mist M is sprayed based on the human body detection by the human body detection sensor 22. On the other hand, when the toilet lid 16 is closed, the mist M is sprayed when the toilet lid rotation detection sensor 24 detects the opening operation of the toilet lid 16. In such a case, the toilet lid rotation detection sensor 24 detects the opening operation at the angle $\alpha$ that is set to any position from the closed state to the half-open state within the rotation range of the toilet lid 16. Accordingly, the pre-mist mode can be finished before the user is seated on the toilet seat 14. When the pre-mist mode is performed, water is adhered to the surface of the bowl 101, which can suppress the adhesion of excrement of the user to the surface of the bowl 101.

An example from when the user enters a toilet room until the user exits the toilet room will now be described.

Figure 6:
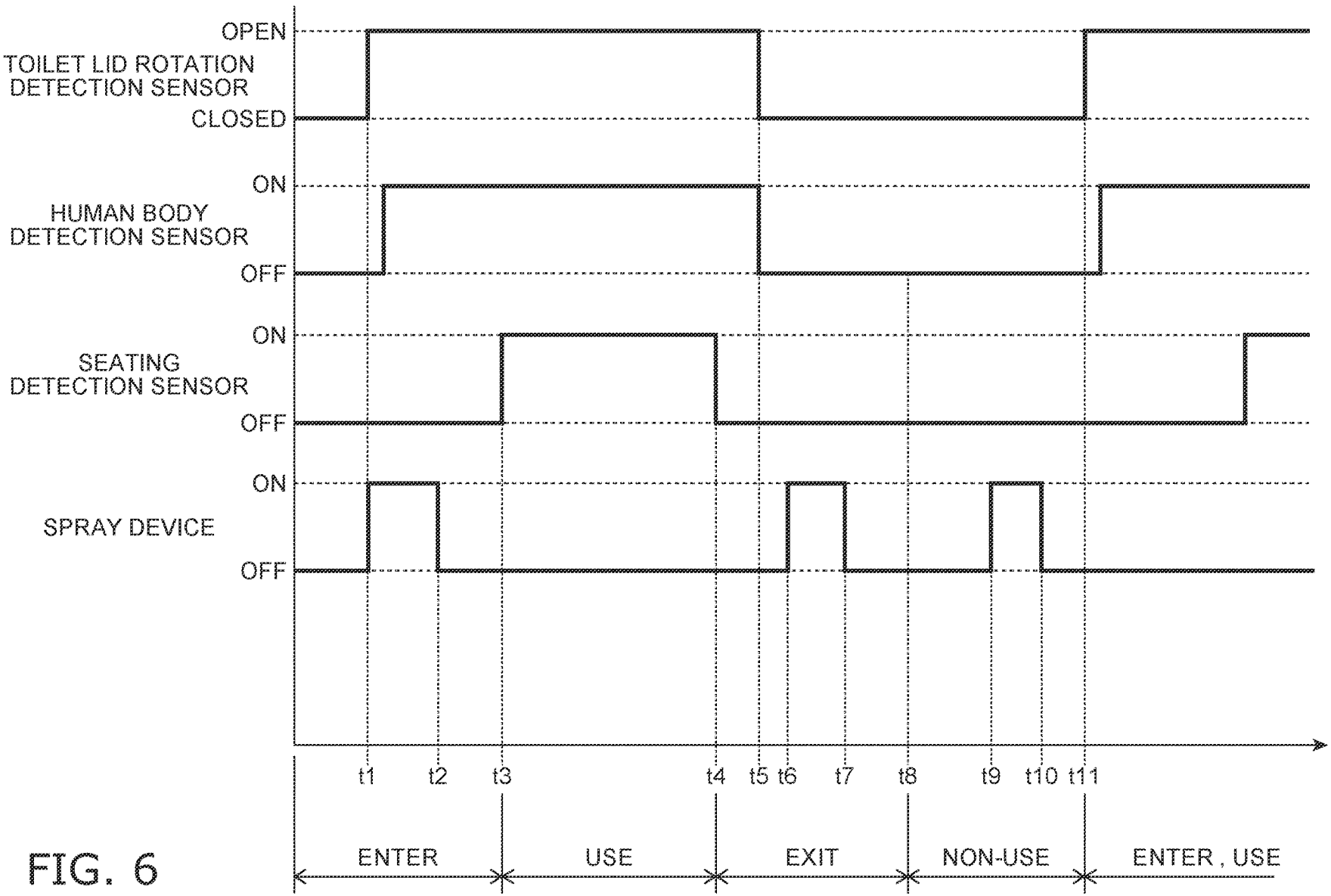
FIG. 6 is a time chart when the user enters the toilet room and the toilet lid is in the closed state.

FIG. 6 is a time chart when the user enters the toilet room and the toilet lid is in the closed state.

The toilet lid 16 is opened by the user at a time t1. Accordingly, the toilet lid rotation detection sensor 24 detects the opening operation of the toilet lid 16. Then, the control device 70 starts the pre-mist mode. In the pre-mist mode, the pipe line 43 is opened by the switch valve 56; and the spray device 60 is switched on (operation start). Accordingly, the spray device 60 sprays the mist M of water toward the surface of the bowl 101. Also, when the toilet lid 16 is in the open state, the human body detection sensor 22 is switched on (detects the user).

The pre-mist mode ends at a time t2. Namely, the control device 70 uses the switch valve 56 to close the pipe line 43, and switches the spray device 60 off (inoperative). The mist spraying by the spray device 60 ends thereby. The interval from the time t1 to the time t2 is several seconds (e.g., 4 seconds). In the pre-mist mode, water is adhered to the surface of the bowl 101 before defecation and urination by the user. The adhesion of the excrement of the user to the surface of the bowl 101 can be suppressed thereby. The control device 70 activates the timer from the end of the pre-mist mode up to the time t2. The next pre-mist mode is restricted during the timer measurement.

The user is seated on the toilet seat 14 at a time t3. The seating detection sensor 20 is switched on (seated detection) when the user is seated on the toilet seat 14. The user has left the toilet seat 14 at a time t4 after the use of the toilet device 1 by the user ends. The seating detection sensor 20 is switched off (unseated detection) when the user has left the toilet seat 14. When the unseating from the toilet seat 14 is confirmed, the control device 70 activates (starts) the timer.

The toilet lid 16 is closed by the user at a time t5. When the user closes the toilet lid 16, the toilet lid rotation detection sensor 24 detects the closing operation. When the closing operation is confirmed by the toilet lid rotation detection sensor 24, the control device 70 cuts the power supply of the human body detection sensor 22. When the closing operation is confirmed by the toilet lid rotation detection sensor 24, the control device 70 may switch the human body detection sensor 22 off (human body nondetection) without cutting the power supply of the human body detection sensor 22.

The after-mist mode is started at a time t6 at which a prescribed interval has elapsed since the timer was started. The interval from the time t4 to the time t6 is several tens of seconds (e.g., 25 seconds). In other words, for example, the after-mist mode is performed after 25 seconds have elapsed from the unseating of the toilet seat 14. In the after-mist mode, the pipe line 43 is opened by the switch valve 56; and the spray device 60 is switched on (operation start). In such a case, the bacteria-removing water that is generated by the bacteria-removing device 54 is supplied by the control device 70 to the spray device 60. Accordingly, the spray device 60 sprays the mist M of bacteria-removing water toward the surface of the bowl 101.

The after-mist mode ends at a time t7. Namely, the control device 70 uses the switch valve 56 to close the pipe line 43, and switches the spray device 60 off (inoperative). The mist spraying by the spray device 60 ends thereby. The interval from the time t6 to the time t7 is several seconds (e.g., 7 seconds). In the after-mist mode, bacteria-removing water is adhered to the surface of the bowl 101 after the defecation and urination by the user. The propagation of bacteria and viruses on the surface of the bowl 101 can be suppressed thereby. The control device 70 activates the timer from the time t7 at which the after-mist mode ends. The pre-mist mode is restricted during the timer measurement.

The user exits the toilet room at a time t8. The exit of the user may be at any time after the time t4. In other words, the exit of the user may be before or while the after-mist is performed. The periodic mist mode is performed from a time t9 to a time t10. For example, the periodic mist mode is performed when the toilet device 1 is less frequently used, after a prescribed interval has elapsed from the after-mist mode or the manual mist mode, etc.

In the periodic mist mode, for example, the mist M of bacteria-removing water is sprayed onto the surface of the bowl 101. The propagation of bacteria and/or viruses on the surface of the bowl 101 can be suppressed thereby. As a result, the toilet device 1 can have high hygiene. The control device 70 activates the timer from the time t10 at which the periodic mist mode ends.

At a time t11, the next user who enters the toilet room opens the toilet lid 16. Accordingly, the toilet lid rotation detection sensor 24 detects the opening operation of the toilet lid 16. The human body detection sensor 22 detects the user when the toilet lid 16 transitions to the open state.

Here, if the interval from the time t10 to the time t11 is within the timer measurement (within the prescribed interval), the pre-mist mode is not performed because the mist M sprayed in the periodic mist mode remains on the surface of the bowl 101. In other words, the control device 70 sets the spray device 60 to be inoperative during the prescribed interval (e.g., within 90 seconds) after the operation of the spray device 60 ends. Accordingly, the toilet device 1 and the sanitary washing device 10 can conserve water and electricity.

Figure 7:
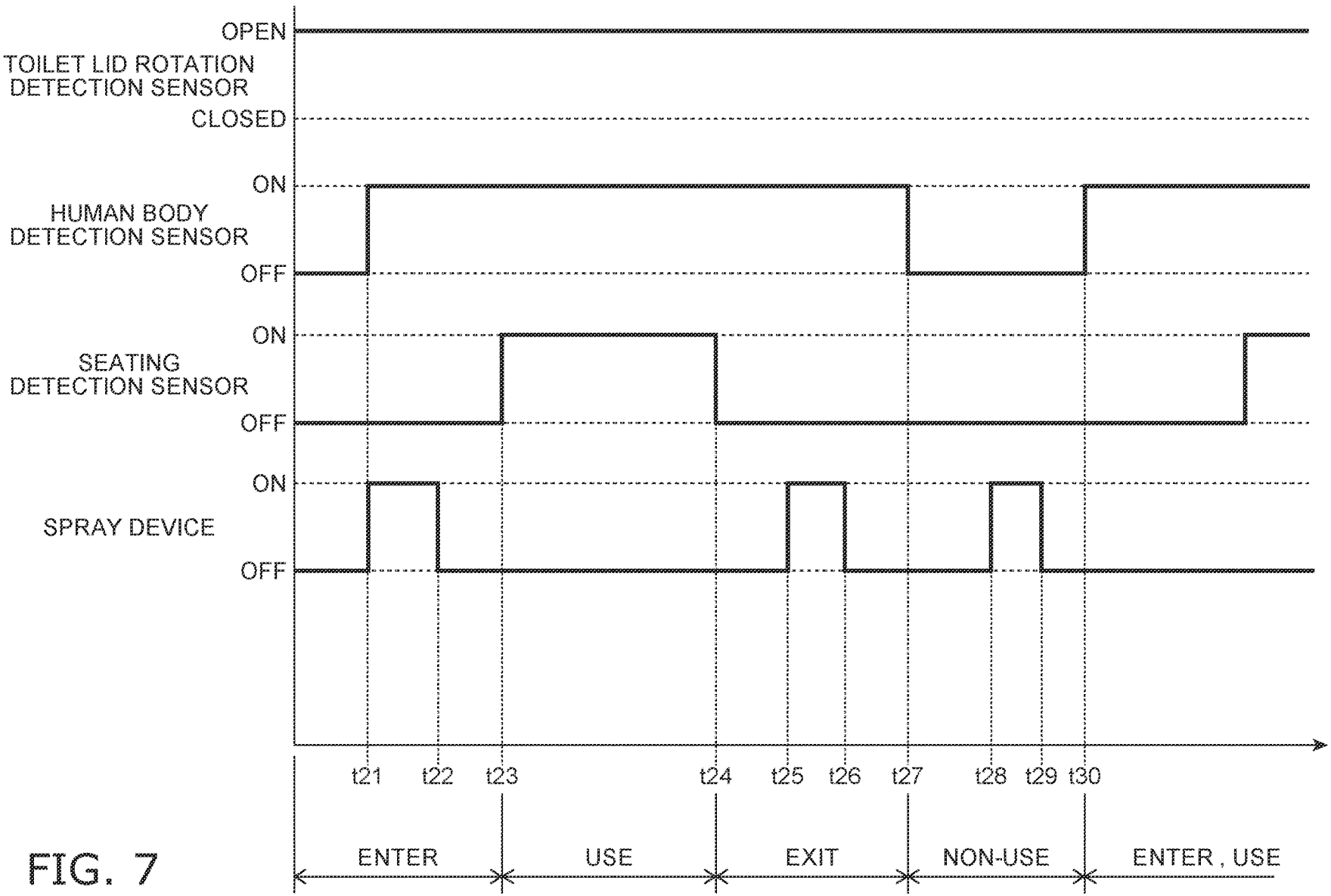
FIG. 7 is a time chart when the user enters the toilet room and the toilet lid is in the open state.

FIG. 7 is a time chart when the user enters the toilet room and the toilet lid is in the open state.

The user enters the toilet room at a time t21. When the user enters the toilet room, the human body detection sensor 22 is switched on (detects the user). Accordingly, the control device 70 starts the pre-mist mode. In the pre-mist mode, the pipe line 43 is opened by the switch valve 56; and the spray device 60 is switched on (operation start). Accordingly, the spray device 60 sprays the mist M of water toward the surface of the bowl 101.

The same control processing as the control processing from the time t2 to the time t4 in FIG. 6 is performed from a time t22 to a time t24. The same control processing as the control processing of the time t6 and the time t7 in FIG. 6 is performed respectively at a time t25 and a time t26. Then, the user exits the toilet room at a time t27. In the example, the user exits with the toilet lid 16 in the open state. Accordingly, the human body detection sensor 22 is off (human body nondetection) at the time t27. Then, the same control processing as the control processing of the time t9 and the time t10 in FIG. 6 is performed respectively at a time t28 and a time t29.

The next user enters the toilet room at a time t30. Accordingly, the human body detection sensor 22 is switched on (user detected). Similarly to the control processing at the time t11 in FIG. 6, for example, the pre-mist mode is not performed within the prescribed interval from the time t29 at which the periodic mist mode ends to the time t30 at which the human body detection sensor 22 detects the human body. Accordingly, the toilet device 1 and the sanitary washing device 10 can conserve water and electricity.

An example is described in the above embodiment in which the after-mist mode is performed after a prescribed interval has elapsed from the unseating of the toilet seat 14. However, aspects of the invention are not limited thereto; for example, the after-mist mode may be performed after a prescribed interval (e.g., 90 seconds) has elapsed after the toilet lid rotation detection sensor 24 detects the closing operation of the toilet lid 16. For example, the after-mist mode may be performed after a prescribed interval (e.g., 90 seconds) has elapsed after the nondetection of the human body by the human body detection sensor 22.

Embodiments may include the following configurations.

Configuration 1

A sanitary washing device, comprising:

a casing disposed at a toilet;

a toilet lid rotatably mounted to the casing;

a rotation detection sensor disposed at the casing, the rotation detection sensor being configured to detect a rotation of the toilet lid;

a human body detection sensor disposed at the casing, the human body detection sensor being configured to detect a human body when the toilet lid is in an open state;

a spray device disposed at the casing, the spray device being configured to spray a mist into the toilet; and a control device configured to control the spray device, the control device being configured to operate the spray device when the rotation detection sensor detects an opening operation of the toilet lid, or when the human body detection sensor detects the human body.

Configuration 2

The sanitary washing device according to Configuration 1, wherein the control device is configured to set the spray device to be inoperative for a prescribed interval after an operation of the spray device ends.

Configuration 3

The sanitary washing device according to Configuration 1 or 2, wherein the rotation detection sensor is configured to detect the opening operation of the toilet lid at a position within a range of not more than half of a rotation range of the toilet lid.

Configuration 4

The sanitary washing device according to any one of Configurations 1 to 3, wherein the toilet lid covers an entirety of the casing when viewed in front-view when the toilet lid is in a closed state.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the sanitary washing device is not limited to the illustration and can be appropriately modified. The components included in the embodiments described above may be combined within the extent of technical feasibility, and any combinations of these components also are included in the scope of the invention to the extent that they include the feature of the invention.

What is claimed is:

1. A sanitary washing device, comprising:

a casing disposed at a toilet;

a toilet lid rotatably mounted to the casing;

a rotation detection sensor disposed at the casing, the rotation detection sensor being configured to detect a rotation of the toilet lid;

a human body detection sensor disposed at the casing, the human body detection sensor being configured to detect a human body located in front of the toilet when the toilet lid is in an open state, wherein when the toilet lid is in a closed state, the human body detection sensor is covered with the toilet lid and cannot detect the human body;

a spray device disposed at the casing, the spray device being configured to spray a mist into the toilet; and a control device configured to control the spray device, the control device being configured to operate the spray device based on human body detection by the human body detection sensor when the toilet lid is open, and to operate the spray device based on detection of an opening operation of the toilet lid by the rotation detection sensor when the toilet lid is closed.

2. The sanitary washing device according to claim 1, wherein the control device is configured to set the spray device to be inoperative for a prescribed interval after an operation of the spray device ends.

3. The sanitary washing device according to claim 1, wherein the rotation detection sensor is configured to detect the opening operation of the toilet lid at a position within a range of not more than half of a rotation range of the toilet lid.

4. The sanitary washing device according to claim 1, wherein the toilet lid covers an entirety of the casing when viewed in front-view when the toilet lid is in a closed state.

* * * * *